United States Patent [19]

Voit

[11] Patent Number: 4,995,331

[45] Date of Patent: Feb. 26, 1991

[54] APPARATUS FOR GLAZING ARTICLES OF EARTHENWARE OR PORCELAIN

[75] Inventor: Karl Voit, Weissenstadt, Fed. Rep. of Germany

[73] Assignee: Michael Voit GmbH Weissenstadt, Fed. Rep. of Germany

[21] Appl. No.: 344,353

[22] Filed: Apr. 26, 1989

[30] Foreign Application Priority Data

May 9, 1988 [DE] Fed. Rep. of Germany ..... 3815822

[51] Int. Cl.[5] ..... B05C 3/10; B05C 13/00

[52] U.S. Cl. ..... 118/46; 118/50; 118/109; 118/409; 118/412; 118/415; 118/416; 118/421; 118/423; 118/428; 118/429; 198/345.1; 198/471.1; 198/803.5; 198/957; 414/225; 427/397.8

[58] Field of Search ..... 427/397.8; 118/50, 56, 118/409, 412, 415, 416, 421, 423, 428, 429, 46, 109; 414/222, 225; 901/7, 16, 40; 198/345, 428, 438, 447, 471.1, 803.5, 844, 846, 847

[56] References Cited

U.S. PATENT DOCUMENTS

| | | | |
|---|---|---|---|
| 3,429,652 | 2/1969 | Varga | 118/56 |
| 3,899,994 | 8/1975 | Cook et al. | 118/56 |
| 4,036,169 | 7/1977 | Harvey | 118/421 |
| 4,169,908 | 10/1979 | Hatfield | 118/200 |
| 4,394,844 | 7/1983 | Wood et al. | 118/421 |
| 4,594,768 | 6/1986 | Gater et al. | 414/225 |
| 4,741,429 | 5/1988 | Hattori et al. | 198/345 |
| 4,759,310 | 7/1988 | Williams et al. | 118/421 |
| 4,805,551 | 2/1989 | Marazzi | 118/312 |

OTHER PUBLICATIONS

"Conveyor & Elevator Belting", Sparks Belting Co., Grand Rapids, MI, sales brochure JH-78, received 12-1979, copy in class 198, subclass 957, p. 5.

*Primary Examiner*—James C. Housel
*Attorney, Agent, or Firm*—Henry M. Feiereisen

[57] ABSTRACT

An apparatus for glazing an article of earthenware or porcelain such as e.g. a plate or the like includes a capstan with a plurality of arms each supporting a workpiece holder for at least one glaze vessel which is rotatable about its axis and tiltable relative to the supporting arm. Before being fed to a glazing station, the article is accurately aligned and imprinted with a mark. A suction unit transfers the article from the centering station to the glaze vessel which is rotated and tilted so as to dip the article in a glaze mass. After surface drying the glaze on the article by initially holding it vertically and then horizontally, the article is transported to a transfer station for placement on a spongy belt which removes excess amount of glaze from the bottom area of the article. The glaze vessel, after being cleared by removing the plate, is refilled with fresh glaze mass in a charging station which is arranged prior to the glazing station.

19 Claims, 5 Drawing Sheets

APPARATUS FOR GLAZING ARTICLES OF EARTHENWARE OR PORCELAIN

BACKGROUND OF THE INVENTION

The present invention relates to an apparatus for and method of glazing articles, in particular glazing cast, turned or pressed articles of earthenware or porcelain, especially plates or the like, with a capstan which has several supporting arms carrying a workpiece holder and is advanced in a cycle between a glazing station and a further station in which the glazed article is horizontally held.

A known glazing apparatus of this type requires complicated driving mechanisms and yet is not suitable to provide a high quality glazing of the ceramics so that the production of high quality porcelain still requires a manual operation of the glazing. Apart from being time consuming and complicated, with such a glazing apparatus the operator who executes the glazing operations is constantly in direct contact with the glaze.

Moreover, with such a glazing apparatus, it is still difficult to apply a uniform glaze to the earthenware or porcelain.

SUMMARY OF THE INVENTION

It is an object of the present invention to provide an improved apparatus for glazing an article of earthenware or porcelain obviating the aforementioned drawbacks.

This object and others which will become apparent hereinafter are attained in accordance with the present invention by providing a capstan including at least one supporting arm with a workpiece holder at one end and rotating the arm in a cycle between a glazing station via at least one intermediate station and a discharge station wherein the glazing station cooperates with a centering station for aligning the article before being transferred by a suction unit into the glazing station.

The workpiece holder is provided with at least one glaze vessel which is rotatable about its axis and tiltable relative to the axis of the supporting arm. In the glazing station, the glaze vessel with the article placed thereon is tilted toward a glaze trough so that the article dips in the glaze mass and is rotated simultaneously to ensure a thorough and complete glazing of its outer surface. The bottom area of the article is glazed by the glaze mass within the interior of the glaze vessel.

According to a further feature of the present invention, after surface drying the glaze by advancing the article through various intermediate stations in which the article is vertically positioned and then horizontally positioned, the article is transported to the discharge station and placed on a spongy belt which removes excess glaze from the bottom area of the article.

According to a yet another feature of the present invention, a charging station succeeds the discharge station and allows a removal of excess and spent glaze and refilling of the glaze vessel with fresh glaze. In the charging station, the glaze vessel is tilted so that a predetermined amount of glaze can be introduced in dependence on the inclination or tilting of the glaze vessel.

The provision of such a glazing apparatus ensures a fully automatic production of glazed articles of earthenware or porcelain at a high quality and at considerable output.

BRIEF DESCRIPTION OF A PREFERRED EMBODIMENT

The above and other objects, features and advantages of the present invention will now be described in more detail with reference to the following drawing in which.

DETAILED DESCRIPTION OF A PREFERRED EMBODIMENT

Figure 1:
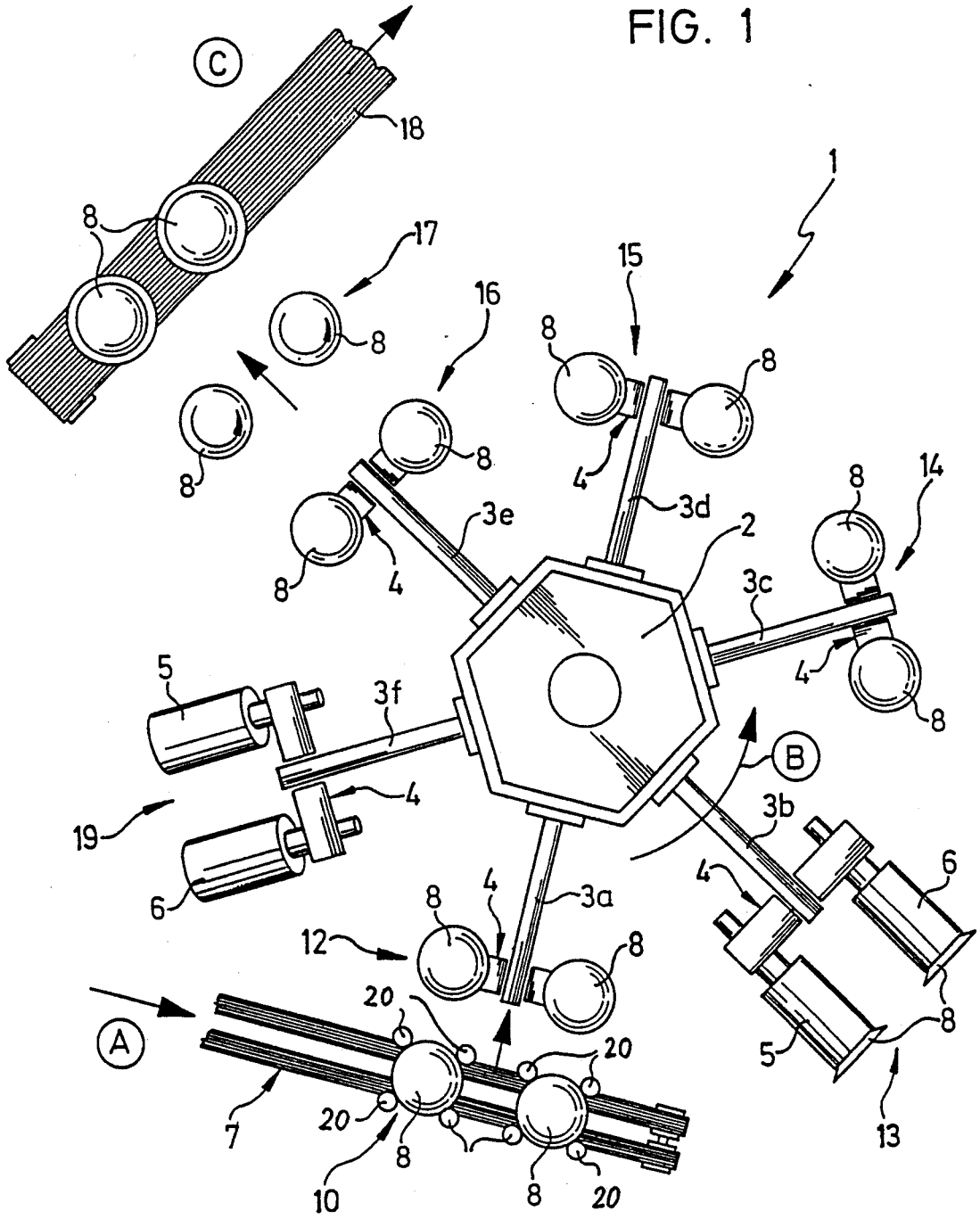
FIG. 1 is an overall illustration in top view of one embodiment of a glazing apparatus in accordance with the present invention.

Referring now to the drawing, and in particular to FIG. 1, there is shown an overall top view of one embodiment of an apparatus for glazing articles, such as plates or the like and made of e.g. earthenware or porcelain. In the non-limiting example of FIG. 1, the glazing apparatus is designated in general by reference numeral 1 and includes a capstan 2 which is provided with six supporting arms *3a, 3b, 3c, 3d, 3e, 3f* evenly spaced about the circumference of the capstan 2. The supporting arms *3a* to *3f* is advanced through various stages in a direction as indicated by arrow B to complete a cycle starting from a feeding area A of the glazing apparatus 1. Each supporting arm *3a* to *3f* is provided at the end distant to the capstan 2 with a workpiece holder generally designated by reference numeral 4 by which the article to be treated is retained during its passage through the various stages of the glazing apparatus 1. Each workpiece holder 4 supports two glazing pots or vessels 5, 6, respectively arranged at each side of the pertaining supporting arm *3a* to *3f*. As will be described furtherbelow, the glaze vessels 5, 6 are rotatable about their axis and are tiltable relative to the axis of its supporting arm *3a* to *3f*. Since the supporting arm *3a* to *3f* is arranged in a horizontal plane, the glaze vessels 5, 6 tilt relative to the horizontal.

The articles such as for example plates 8 which are to be treated in the glazing apparatus 1 are transported by a conveyer 7 in direction of arrow A from a feeding area to a centering station generally designated by reference numeral 10. The conveyor 7 is of a type having two belts spaced from each other so as to define an open intermediate space therebetween. In the centering station 10, the plates 8 are aligned with regard to the opposing glaze vessel 5, 6 by a set of four rollers 20 to allow accurate transfer of the plates 8 from the conveyor 7 to the glaze vessels 5, 6. After being aligned or centered, the plates 8 are transferred in axial direction of the supporting arm *3a* to the respective glaze vessel 5, 6 within a glazing station which is generally designated by reference numeral 12 and shown in more detail in FIG. 4.

In order to allow a surface drying of the layer of glaze on the plates 8 before being discharged for further treatment, the plates 8 are advanced by the capstan 2 in the direction of arrow B through various intermediate stations 13, 14, 15. When reaching the station 13, the previous horizontal alignment of the plates 8 is changed into an essentially vertical alignment by suitably turning the workpiece holder 4. In station 14, the plates 8 are returned into an essentially horizontal position which is maintained through station 15 until reaching a transfer station generally designated by reference numeral 16 in which the plates 8 are transferred to a cleansing area 17 for removing excess amount of glaze from the plates 8. Finally, the glazed plates 8 are transferred to a further conveyer belt 18 in a discharge area C, with the conveyer belt 18 moving in direction of the arrow and transporting the glazed plates 8 from the glazing apparatus 1 e.g. to a kiln for further treatment.

After the plates 8 have been removed from the glaze vessels 5, 6, a further rotation of the capstan 2 advances the respective supporting arm 3*a* to 3*f* to a charging station generally designated by reference numeral 19 and located immediately before the centering station in order to complete the cycle. As will be described in more detail with reference to FIG. 8, in the charging station 19, the glaze vessels 5, 6 are refilled with new glaze while glaze still contained in the glaze vessel 5, 6 is removed for quality reasons.

Figure 2:
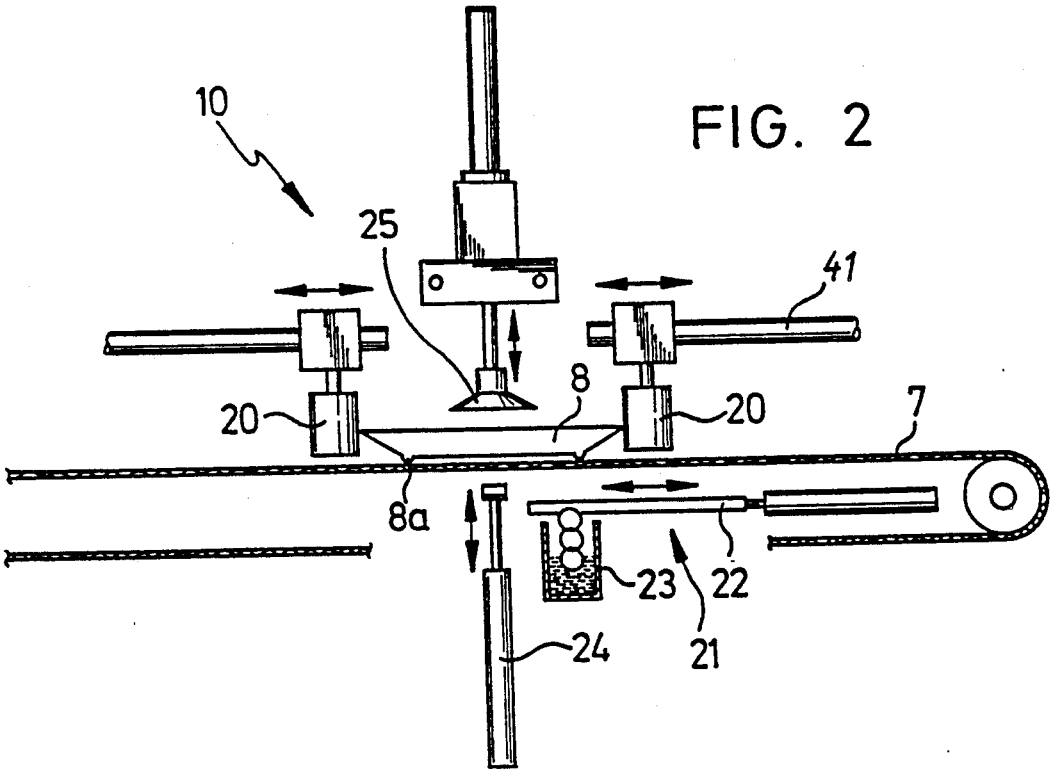
FIG. 2 is a side view of a centering station of the glazing apparatus in cooperation with an imprinter.
Figure 3:
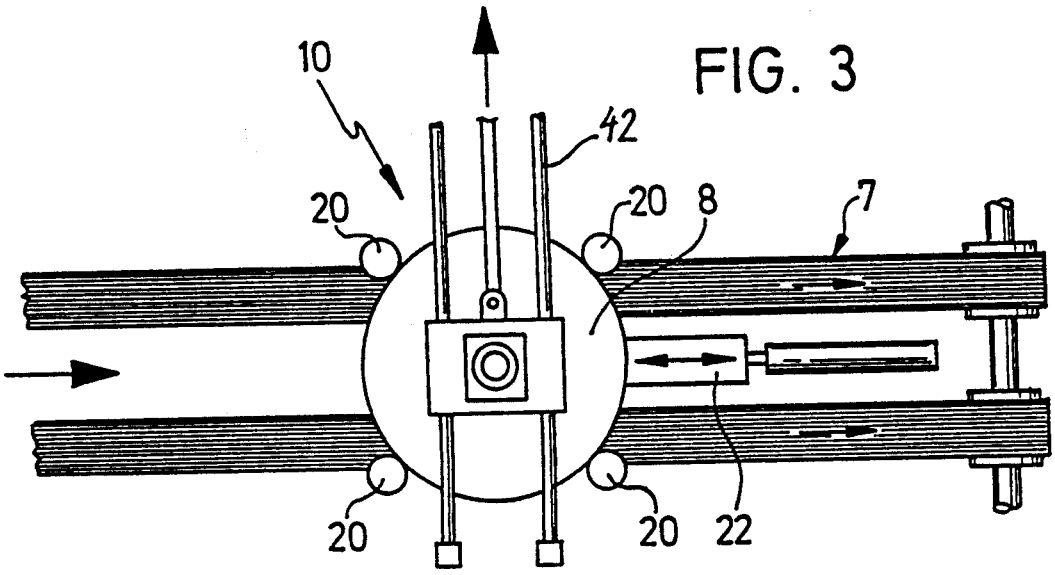
FIG. 3 is a top view of the centering station according to FIG. 2.

Turning now to FIGS. 2 and 3, there are shown a side view and a top view of the centering station 10. As can be seen therefrom, the centering station 10 includes several, preferably four diagonally opposite centering rollers 20 for aligning and centering each plate 8 before being transferred to the respective glaze vessel 5, 6. Since each workpiece holder 4 is adapted for carrying two glaze vessels, the centering station 10 includes two sets of four such rollers 20 in order to allow two plates 8 to be accurately positioned and simultaneously be transferred to the respective glaze vessel as indicated in particular in FIG. 1.

The rollers 20 are supported by guide rails 41 to allow translational movement thereof in horizontal direction as indicated with arrows so that the approaching plates 8 force the rollers 20 outwardly until being enclosed by the rollers 20 as shown in FIG. 3. Arranged below the upper run of the conveyer 7 is an imprinter generally designated by reference numeral 21 for allowing the outer surface of the bottom of the plate 8 to be stamped with a desired mark. The imprinter 21 includes a ink palette 22 movable in a horizontal direction as indicated by the double arrow, an ink reservoir 23 and a punch head 24 movable in vertical direction as indicated by the respective double arrow. The ink palette 22 moves between the ink reservoir 23 and the punch head 24 which during its upward movement takes up ink from the palette 22 and advances through the space between the belts of the conveyor 7 to apply a mark to the facing bottom of the plate 8. Evidently, the imprinting of the outer bottom surface of the plate 8 takes place after aligning the article between the rollers 20.

Figure 4:
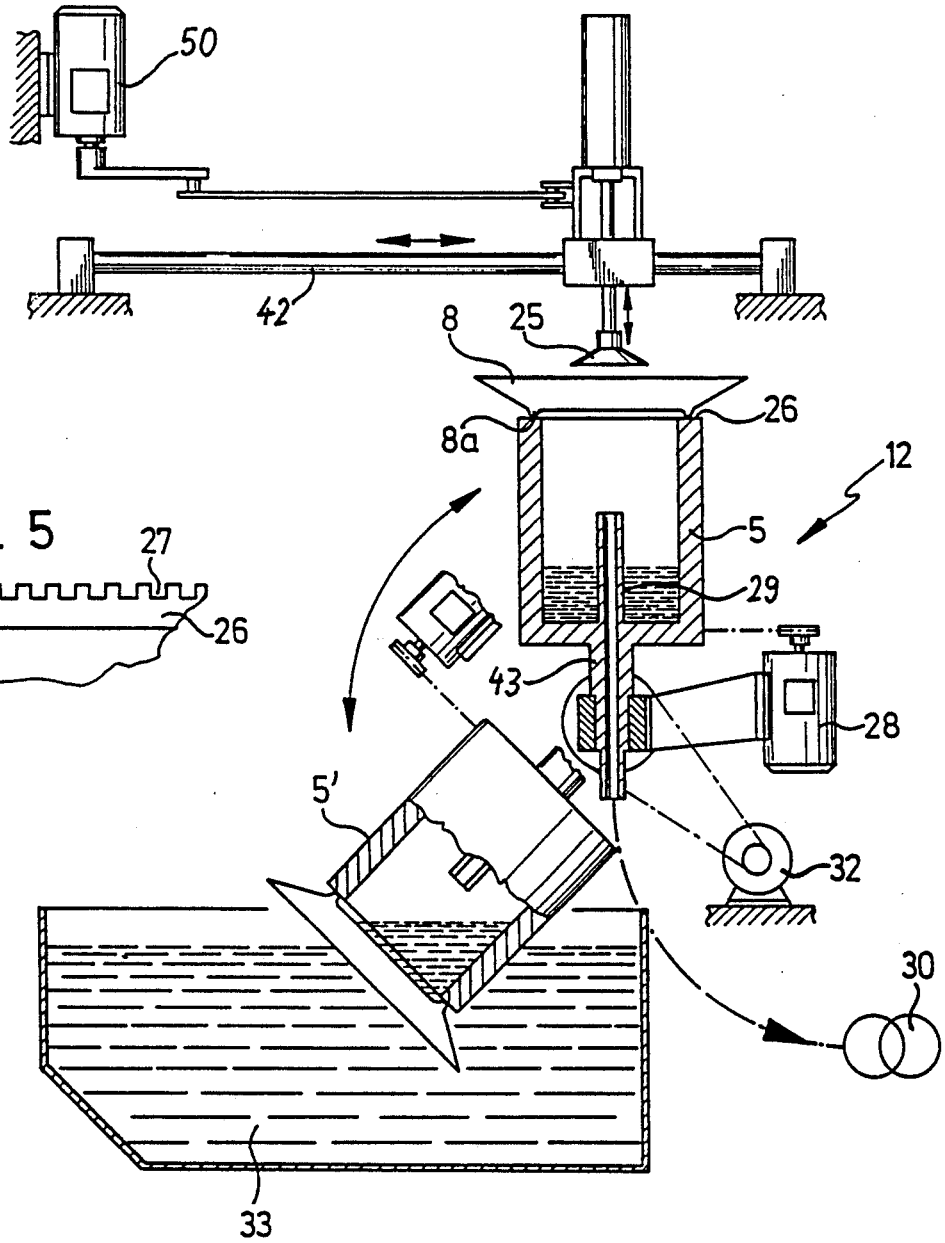
FIG. 4 is a side view of the glazing station of the glazing apparatus and illustrating a transfer from the centering station to the glazing station.

After imprinting the outer bottom surface, the plates 8 are transferred from the conveyer 7 to the glaze vessels 5, 6. The transfer is carried out by a suction unit provided at its end facing the plate 8 with a suction cup 25. As shown in FIG. 2 by the double arrow, the suction unit is movable in vertical direction e.g. by means of a pneumatic cylinder. The suction unit is also movable in a horizontal direction along guide rails 42 by means of a motor 50 (FIG. 4). Thus, the suction cup 25 is shifted horizontally until being positioned above the plate 8 and then is lowered to grip the plate 8 and after reversal to place the plate 8 on top of the glaze vessel 5, 6 in the glazing station 12.

Turning now to FIG. 4, there is shown a side view of the glazing station 12 in which only one of the two glaze vessels 5, 6 is illustrated. Since the glaze vessels 5, 6 are of identical design, the following description refers only to glaze vessel 5.

Figure 5:
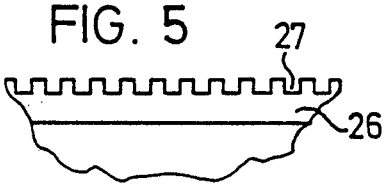
FIG. 5 is a detail of a glazing vessel, illustrating an elastic receiving surface at the top of the glaze vessel.

The glaze vessel 5 is essentially of hollow cylindrical shape to define an interior in which a specific amount of glaze is contained. At its upper side, the glaze vessel 5 is provided with an annular elastic receiving surface 26. The elasticity of the receiving surface 26 can be attained by suitable material selection or suitable design. As shown by way of example in FIG. 5, the elastic receiving surface 26 includes a number of radial grooves 27 by which a glaze accumulation at the footing 8*a* of the plate 8 is prevented. Although not shown in the drawing, the receiving surface 26 may also slightly incline relative to the axis of the glaze vessel 5 in order to allow the receiving surface 26 together with its elasticity to be adjusted to the shape of the footing 8*a* of the plate 8.

The glaze vessel 5 is provided at its lower end with a central projection 43 by which the glaze vessel 5 is supported in the holder 4. Operatively connected to the projection 43 is a speed controlled motor 28 by which the glaze vessel 5 is rotatable about its own axis. The projection 43 has a channel which is extended into the interior of the glaze vessel 5 by a suction pipe 29 which extends into the interior of the glaze vessel 5 to about half of its height. The suction pipe 29 is connected to an aspirator 30 so as to generate an underpressure in the interior of the glaze vessel 5. By means of the underpressure, the plate 8 placed on the receiving surface 26 of the glaze vessel 5 is sufficiently retained during its advance through the various stations of the glazing apparatus 1.

It will be appreciated that the receiving surface 26 may be wider than shown in the example of FIG. 4 in order to permit the use of the glaze vessels 5, 6 for plates 8 of varying diameter. The radial grooves 27 can suitably be designed at a width of 1 mm and a depth of approximately 0.1 mm. The aspirator 30 generates a small underpressure in the glaze vessel 5 upon high air volume.

The provision of the radial grooves 27 allows a predetermined admission of air in order to prevent a glaze accumulation at the footing 8*a* of the plate 8.

As is further shown in FIG. 4, each glaze vessel 5 is operatively connected with a controllable motor 32 by which the glaze vessel 5 with the plate 8 placed thereon and retained by the prevailing underpressure in the interior of the glaze vessel 5 is tiltable so as to allow the glaze vessel 5 to partly dip into a glaze trough 33 as indicated by the glaze vessel 5' shown in broken lines. Simultaneously with the tilting, the glaze vessel 5 is rotated by the motor 32. Thus, the plate 8 is glazed at its outer surface. As the glaze vessel 5 is rotated by the motor 32, it is sufficient to immerse the plate 8 only partially in the glazing mass in the trough 3 in order to ensure a complete glazing of the plate 8.

Simultaneously with glazing the outer surface of the plate, its bottom surface facing the interior of the glaze vessel 5 is glazed since a predetermined amount of glaze is already contained in the glaze vessel 5 before the plate 8 is placed on the receiving surface 26 as will be described with reference to FIG. 8. When tilting the glaze vessel 5 as shown in FIG. 4 in broken lines, the amount of glaze within the glaze vessel 5 allows a complete glazing of the bottom surface of the plate 8.

Depending on the shape and dimension of the article to be glazed, the speed and tilting of the glaze vessels 5, 6 are controlled in such a manner so as to ensure a reliable and unobjectionable glazing of the article in the glazing station 12.

After glazing the plate 8, the glaze vessel 5 is advanced past the intermediate station 13 in which the plate 8 is swivelled into a vertical position and past the intermediate station 14 in which the plate 8 is returned into the horizontal position, and is moved past the intermediate station 15 until reaching the transfer station 16. During advancing through the intermediate stations 13, 14, 15, the layer of glaze applied in the glazing station 12 to the plates 8 is suitably dried before reaching the transfer station 16.

Figure 6:
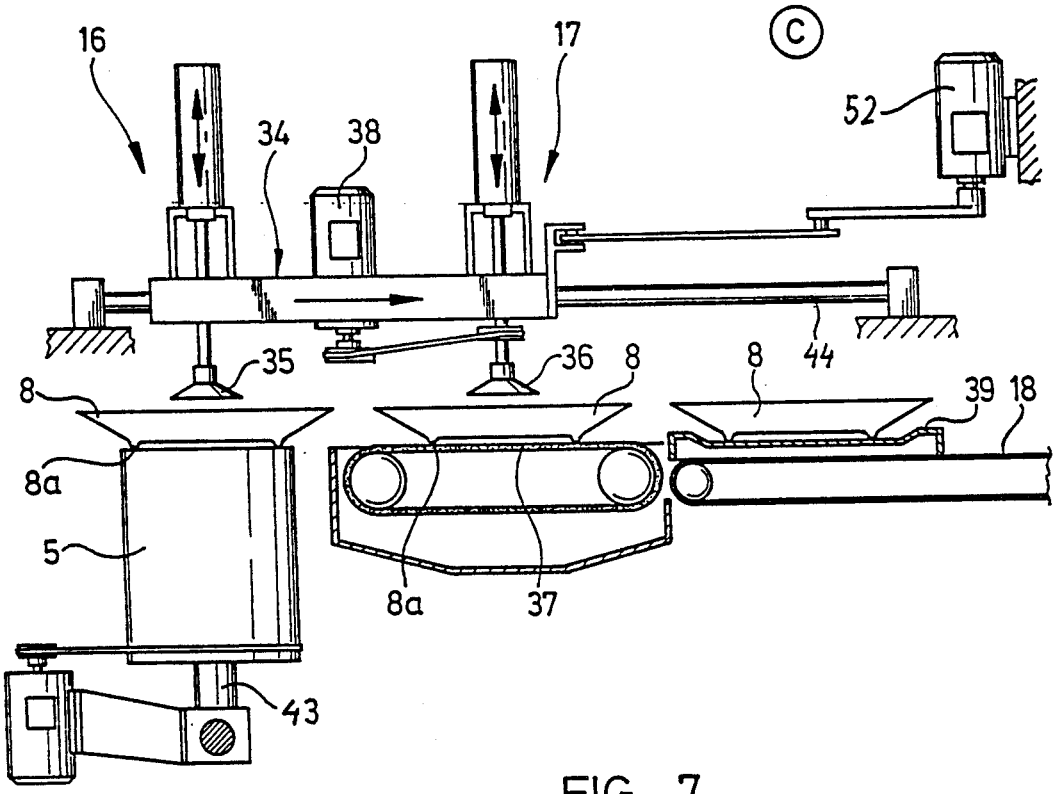
FIG. 6 is a side view of the transfer station of the glazing apparatus.
Figure 7:
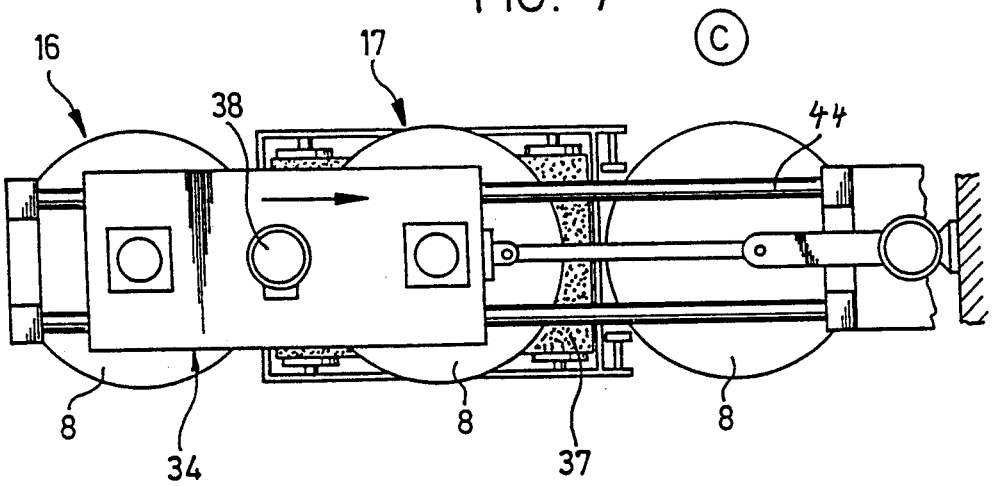
FIG. 7 is a top view of the transfer station according to FIG. 6.

FIGS. 6 and 7 illustrate in a side view and a top view in more detail the transfer station 16 with the cleansing area 17 associated therewith. The transfer station 16 includes a suction unit generally designated with reference numeral 34 and movable in a horizontal direction via respective guide rails 44 by a motor 52. The suction unit 34 includes a suction cup 35 which is movable upwardly and downwardly in a vertical direction and by which the plate 8 is picked up from the glaze vessel 5 and after horizontal movement is placed on a spongy belt or absorbent belt 37 in the area 17 for removing excess glaze. After placing the plate 8 on the spongy belt 37, the suction cup 35 is returned into the original position as shown on the left hand side in FIG. 6.

The suction unit 34 is further provided with a second suction cup 36 which is also movable upwardly and downwardly in a vertical direction and by which the plate 8 after being placed on the spongy belt 37 by the suction cup 35 is rotated about its own axis by a further motor 38 while the spongy belt 37 circulates. The spongy surface of the belt 37 thus clears the footing 8*a* of the plate 8 from adhering glaze.

After removing excess glaze from the plate 8, the suction cup 36 lifts the plate 8 from the spongy belt 37 and transfers it to the conveyer belt 18 which is arranged in the discharge area C. The conveyer belt 18 is for example provided with saggars 39 in which the plates 8 are inserted for further transport to a kiln (not shown).

Although not shown in FIGS. 6 and 7, it will be appreciated that the transfer station 16 may certainly have two suction units 34 arranged parallel adjacent to each other so that the transfer of articles from the glaze vessels 5, 6 to the cleansing area 17 and to the conveyor belt 18 can simultaneously be carried out. Preferably, the suction units 34 are synchronized in such a manner that upon transfer of the article from the spongy belt 37 by the suction cup 36, a further article is picked up by the suction cup 35 from the pressure vessels 5, 6 and placed on the spongy belt 37.

Figure 8:
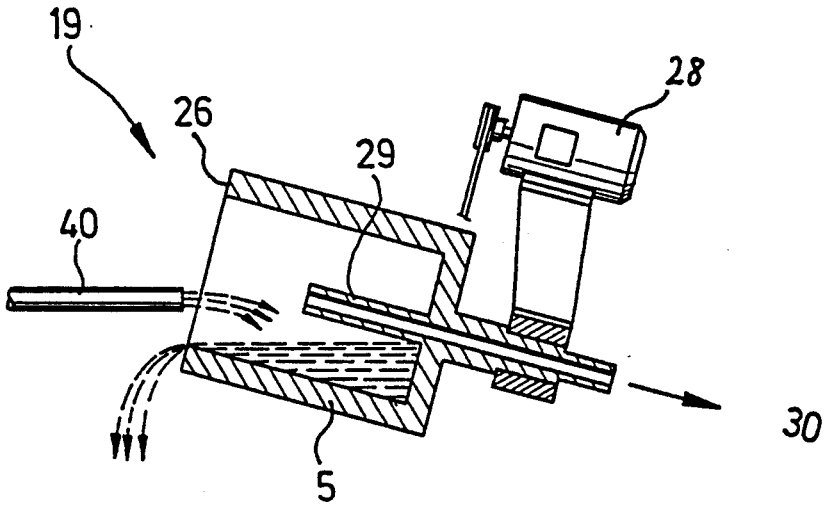
FIG. 8 is a schematic illustration of a charging station for removing glaze and refilling the glaze vessel with fresh glaze after moving past the transfer station and prior to the centering station.

Turning now to FIG. 8, there is shown a particular detail of the charging station 19 which follows the transfer station 16 and allows discharge of remaining glaze from the glaze vessel 5 and refilling with fresh glaze mass. For ease of illustration, FIG. 8 shows only one glaze vessel 5. At the charging station 19, a glaze overflow conduit 40 is provided which is part of a not shown glaze circulation unit and opens into the interior of the glaze vessel 5 which is tilted into a predetermined position. In dependence of the tilting position of the glaze vessel 5, a predetermined level of glaze is defined within the interior of the glaze vessel 5 which level corresponds to the amount of glaze required for glazing the outer bottom surface of the article. As indicated by the arrows, excess amount of glaze which is drawn by the prevailing underpressure from the radial grooves 27 into the interior of the glaze vessel 5 is thus discharged and collected in a suitable reservoir and is returned to the circulation via a suitable screening device.

When introducing fresh amount of glaze into the glaze vessel 5 via the overflow conduit 40, the glaze still present in the interior of the glaze vessel 5 can be exchanged. By suitably selecting the tilting of the glaze vessel 5, the level of glaze within the glaze vessel 5 can easily be adjusted so that the correct amount of glaze is contained within the glaze vessel 5 for glazing the bottom area of the article. Thus, the glazing apparatus 1 can be adjusted to required conditions. Glaze which may flow at the outer surface of the glaze vessels 5, 6 and of the receiving surface 26 may be removed by suitable cleaning devices.

While the invention has been illustrated and described as embodied in an apparatus for and method of glazing an article, it is not intended to be limited to the details shown since various modifications and structural changes may be made without departing in any way from the spirit of the present invention.

What is claimed as new and desired to be protected by Letters Patent is set forth in the appended claims.

I claim:

1. Apparatus for glazing an article, comprising:

a rotating support means for glazing the article in a glazing station and transporting the article in a working cycle from said glazing station to a discharge station from which the finished article is transported away for further processing, said support means including a capstan, at least one supporting arm defining an axis and having one end connected to said capstan, a workpiece holder mounted to the other end of said arm, and at least one glaze vessel defining an axis of rotation and mounted to said workpiece holder;

centering means provided in a centering station for centering the article in alignment with a first suction means by which the article is transferred from said centering station to said glaze vessel;

means for rotating said glaze vessel about said axis of rotation;

means for tilting said glaze vessel relative to said axis of said supporting arm; and means for holding the article on said glaze vessel.

2. Apparatus as defined in claim 1, and further comprising a transfer station arranged subsequently to a first intermediate station in which the article is held in a substantially horizontal position, said transfer station including an absorbent belt for removing adhering glaze from the article and second suction means for transferring the article from said support means to said absorbent belt.

3. Apparatus as defined in claim 2 wherein said second suction means includes at least two suction units extending coaxially with said supporting arm and having a means for vertically moving said suction units relative to said supporting arm and said absorbent belt, with one of said suction units transferring the article from said support means to said absorbent belt and said other suction unit having a means for rotating the article on said absorbent belt and transferring the article to said discharge station.

4. Apparatus as defined in claim 3 wherein said suction units are synchronized in such a manner that upon transfer of the article from said absorbent belt a further article is transferred from said support means to said absorbent belt.

5. Apparatus as defined in claim 2, and further comprising a second intermediate station between said first intermediate station and said transfer station, the article being held in horizontal alignment in said first and second intermediate stations.

6. Apparatus as defined in claim 1, and further comprising a charging station located after said discharge station and prior to said glazing station, said charging station including a glaze overflow unit cooperating with said glaze vessel to provide a predetermined level of glaze within said glaze vessel.

7. Apparatus as defined in claim 6 wherein said glaze vessel is tilted upon entering said charging station to a position in which said glaze vessel has a predetermined inclination relative to the horizontal, said inclination of said glaze vessel determining the level of glaze in said glaze vessel.

8. Apparatus as defined in claim 1 wherein said glaze vessel has a top provided with an elastic receiving surface for supporting the article.

9. Apparatus as defined in claim 8 wherein said glaze vessel defines a center axis, said receiving surface being inclined relative to said center axis of said glaze vessel.

10. Apparatus as defined in claim 8 wherein said receiving surface is provided with a number of radial grooves.

11. Apparatus as defined in claim 1 wherein said holding means includes an aspirator communicating with the interior of said glaze vessel for generating a slight underpressure in said glaze vessel.

12. Apparatus as defined in claim 11 wherein said holding means further includes a suction pipe projecting into the interior of said glaze vessel, said aspirator being connected to said suction pipe.

13. Apparatus as defined in claim 12 wherein said suction pipe projects into the interior of said glaze vessel to about half the height of said glaze vessel.

14. Apparatus as defined in claim 1 wherein said glazing station is provided with a trough containing glaze, said glaze vessel being rotated about its axis in said glazing station and tiltable into said trough for allowing an outer surface of the article to be glazed.

15. Apparatus as defined in claim 1 wherein said centering means includes a plurality of diagonally opposing rollers which are translationally movable in a horizontal direction.

16. Apparatus as defined in claim 1, and further comprising imprinter means arranged in said centering station for stamping a mark on an outer bottom surface of the article after centering the article, said imprinter means including a punch head movable in vertical direction toward said outer bottom surface and an ink palette movable in horizontal direction, with said punch head being inked by horizontally moving said ink palette across said punch head.

17. Apparatus as defined in claim 1 wherein said support means includes two glaze vessels mounted to said workpiece holder.

18. Apparatus for glazing an article, comprising:

a rotating support means for glazing the article in a glazing station and transporting the article in a working cycle from said glazing station to a discharge station from which the finished article is transported away for further processing;

centering means provided in a centering station for centering the article in alignment with a first suction means by which the article is transferred from said centering station to said support means;

an absorbent belt arranged in a transfer station prior to said discharge station for removing adhering glaze from the article; and second suction means including a pair of suction units for transferring the article from said support means to said absorbent belt, each unit having a means for vertically moving said suction units relative to said support means and absorbent belt, with one of said suction units having a means for rotating the article supported thereon.

19. Apparatus as defined in claim 18 wherein said suction units are synchronized in such a manner that upon transfer of the article from said absorbent belt to said discharge station by said one suction unit a further article is transferred from said support means to said absorbent belt by said other suction unit.

* * * * *